US006811428B1

(12) United States Patent
Sawyer et al.

(10) Patent No.: US 6,811,428 B1
(45) Date of Patent: Nov. 2, 2004

(54) SPLICE CONNECTOR ASSEMBLIES AND METHODS FOR USING THE SAME

(75) Inventors: Charlie Sawyer, Orlando, FL (US); Isaac White, Orlando, FL (US); James Dickens, Ocoee, FL (US); Blake Urban, Lenoir, NC (US); Kevin Forsberg, Orlando, FL (US)

(73) Assignee: Bellsouth Intellectual Property Corporation, Wilmington, DE (US)

( * ) Notice: Subject to any disclaimer, the term of this patent is extended or adjusted under 35 U.S.C. 154(b) by 0 days.

(21) Appl. No.: 10/429,813

(22) Filed: May 5, 2003

(51) Int. Cl.[7] ..... H01R 11/20
(52) U.S. Cl. ..... 439/403; 439/519
(58) Field of Search ..... 439/417, 401–405, 439/519, 521, 409–410, 284, 597

(56) References Cited

U.S. PATENT DOCUMENTS

| | | | | | |
|---|---|---|---|---|---|
| 4,178,055 | A | * | 12/1979 | Fleischhacker et al. | 439/402 |
| 4,252,397 | A | * | 2/1981 | Eigenbrode et al. | 439/405 |
| 4,435,034 | A | | 3/1984 | Aujla et al. | 339/98 |
| 5,080,606 | A | * | 1/1992 | Burkard | 439/403 |
| 5,153,988 | A | * | 10/1992 | Mattis et al. | 29/863 |
| 6,080,006 | A | * | 6/2000 | Broder | 439/409 |
| 6,284,977 | B1 | * | 9/2001 | Boron et al. | 174/88 R |
| 6,361,353 | B1 | * | 3/2002 | Saka et al. | 439/405 |
| 6,685,497 | B1 | * | 2/2004 | Urban et al. | 439/417 |

OTHER PUBLICATIONS

U.S. patent application Ser. No. 10/330,454, filed Dec. 28, 2002.

* cited by examiner

*Primary Examiner*—P. Austin Bradley
*Assistant Examiner*—Edwin A. Leon
(74) *Attorney, Agent, or Firm*—Myers Bigel Sibley & Sajovec, P.A.

(57) ABSTRACT

A splice connector assembly for mechanically and electrically connecting a conductor pair including a first conductor member and a second conductor member, and for use with an electrical probe, includes a connector body adapted to receive the first and second conductor members. The connector body includes first and second body members. The first body member has first and second opposed sides. The second body member is adapted to engage the first body member. A terminal member is provided. The terminal member includes a first terminal disposed on the first side of the first body member and adapted to electrically engage the first conductor member, and a second terminal disposed on the second side of the first body member and electrically connected to the first terminal. The second terminal is adapted to electrically engage the second conductor member. An access hole is formed in the connector body and is adapted to receive the probe such that the probe can selectively contact the terminal member. The splice connector assembly is arranged and configured to crimp the first conductor member to the first terminal when the first and second body members are engaged with the first conductor member positioned therebetween. The connector body is adapted to receive the first conductor member from the first side thereof to engage the first terminal, and is adapted to receive the second conductor member from the second side thereof to engage the second terminal.

28 Claims, 5 Drawing Sheets

SPLICE CONNECTOR ASSEMBLIES AND METHODS FOR USING THE SAME

FIELD OF THE INVENTION

The present invention relates to electrical connectors and, more particularly, to splice connectors.

BACKGROUND OF THE INVENTION

Connectors are used throughout the telecommunications industry and the electronics industry in general to connect wires or other conductor members. Such connectors may allow one wire or conductor member to be spliced or electrically connected to another wire or conductor member. Although these connectors are used throughout the electronics industry, such connectors are particularly suited for connection of the "ring and tip" connectors of telephone systems. The conductor members to be connected are typically inserted into the connector and the connector is crimped or clamped to electrically connect the wires.

Although there are many existing connectors of varying designs, these prior art connectors have disadvantages. Some prior art connectors, for example, have no means for testing the connected wires. If an operator must test the connection or the wires after a connector has been installed, for example by crimping, the operator must first cut the connector from one or more of the wires. The wires typically must then be stripped of their outer insulation to allow the operator to take measurements such as current and/or voltage measurements. If the operator determines that no problem is present at the connector or in the tested wires, then the connection has been unnecessarily destroyed. Typically, the operator must then install a new connector. Accordingly, troubleshooting wires connected using connectors of such prior art designs may be a slow task in which many functioning connectors are wasted.

SUMMARY OF THE INVENTION

According to embodiments of the present invention, a splice connector assembly for mechanically and electrically connecting a plurality of conductor pairs, each of the conductor pairs including a first conductor member and a second conductor member, and for use with an electrical probe, includes a connector body adapted to receive the first and second conductor members. The connector body includes first and second body members. The first body member has first and second opposed sides. The second body member is adapted to engage the first body member. A plurality of terminal members are provided. Each terminal member includes a first terminal adapted to electrically engage a respective one of the first conductor members, and a second terminal electrically connected to the first terminal of the terminal member and adapted to electrically engage a respective one of the second conductor members. At least one access hole is formed in the connector body and is adapted to receive the probe such that the probe can selectively contact each of the terminal members. The splice connector assembly is arranged and configured to crimp each of the first conductor members to a respective one of the first terminals when the first and second body members are engaged with the first conductor members positioned therebetween. The connector body is adapted to receive the first conductor members from the first side thereof to engage the first terminals, and is adapted to receive the second conductor members from the second side thereof to engage the second terminals.

According to further embodiments of the present invention, a splice connector assembly for mechanically and electrically connecting a conductor pair including a first conductor member and a second conductor member, and for use with an electrical probe, includes a connector body adapted to receive the first and second conductor members. The connector body includes first and second body members. The first body member has first and second opposed sides. The second body member is adapted to engage the first body member. A terminal member is provided. The terminal member includes a first terminal disposed on the first side of the first body member and adapted to electrically engage the first conductor member, and a second terminal disposed on the second side of the first body member and electrically connected to the first terminal. The second terminal is adapted to electrically engage the second conductor member. An access hole is formed in the connector body and is adapted to receive the probe such that the probe can selectively contact the terminal member. The splice connector assembly is arranged and configured to crimp the first conductor member to the first terminal when the first and second body members are engaged with the first conductor member positioned therebetween. The connector body is adapted to receive the first conductor member from the first side thereof to engage the first terminal, and is adapted to receive the second conductor member from the second side thereof to engage the second terminal.

According to further embodiments of the present invention, a splice kit for mechanically and electrically connecting a conductor pair including a first conductor member and a second conductor member, and for testing an electrical characteristic of the first and second conductor members, includes a probe device and a splice connector assembly. The probe device includes an elongated probe portion. The splice connector assembly includes a connector body adapted to receive the first and second conductor members. The connector body includes first and second body members. The first body member has first and second opposed sides. The second body member is adapted to engage the first body member. A terminal member is provided. The terminal member includes a first terminal disposed on the first side of the first body member and adapted to electrically engage the first conductor member, and a second terminal disposed on the second side of the first body member and electrically connected to the first terminal. The second terminal is adapted to electrically engage the second conductor member. An access hole is formed in the connector body and adapted to receive the probe portion such that the probe portion can selectively contact the terminal member. The splice connector assembly is arranged and configured to crimp the first conductor member to the first terminal when the first and second body members are engaged with the first conductor member positioned therebetween. The connector body is adapted to receive the first conductor member from the first side thereof to engage the first terminal, and is adapted to receive the second conductor member from the second side thereof to engage the second terminal.

According to further embodiments of the present invention, a test clamp assembly includes a clamp including a pair of opposed, relatively movable arms. An elongated probe portion is coupled to the clamp such that the probe portion is movable between a stored position adjacent the clamp and an operational position extending beyond the clamp.

According to method embodiments of the present invention, a method for splicing a conductor pair and testing an electrical characteristic of the conductor pair, the conductor pair including first and second conductor members, includes providing a splice connector assembly. The splice connector assembly includes: a connector body including first and second body members, the first body member having first and second opposed sides, and the second body member being adapted to engage the first body member; a terminal member including a first terminal disposed on the first side of the first body member. A second terminal is disposed on the second side of the first body member and is electrically connected to the first terminal; and an access hole formed in the connector body. The method further includes: engaging the first conductor member with the first terminal from the first side of the first body member; electrically engaging the second conductor member with the second terminal from the second side of the first body member; and inserting a probe device through the access hole to contact the terminal member to thereby determine the electrical characteristic of the conductor pair. The step of engaging the first and second conductor members with the first and second terminals includes engaging the first and second body members such that the first conductor member is crimped to the first terminal.

The present invention will be appreciated by those of ordinary skill in the art from a reading of the figures and the detailed description of the preferred embodiments which follow, such description being merely illustrative of the present invention.

DETAILED DESCRIPTION OF THE PREFERRED EMBODIMENTS

Figure 1:
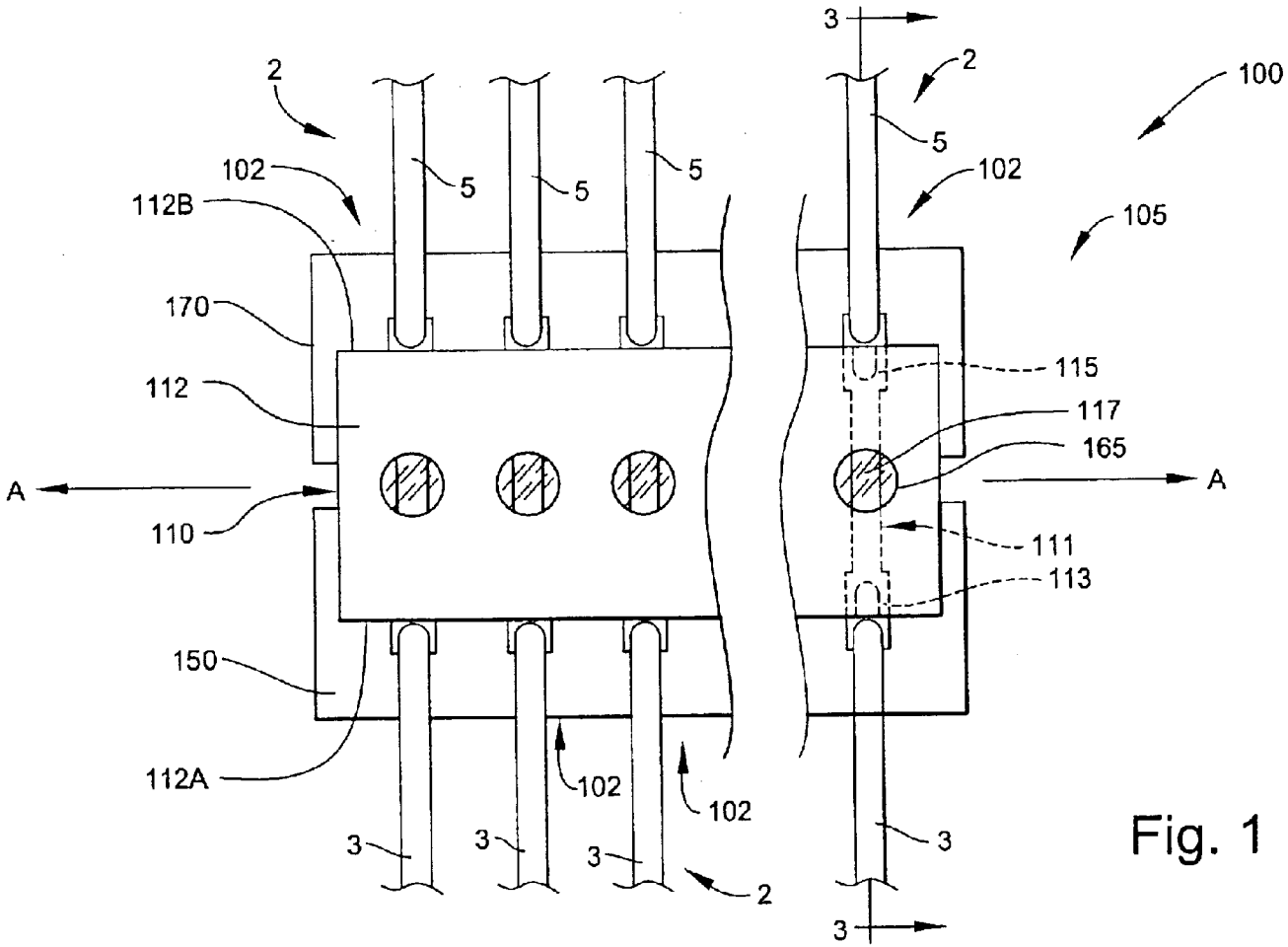
FIG. 1 is a top view of a splice connector assembly according to embodiments of the present invention along with multiple pairs of conductor members, such as wires, spliced together by the splice connector assembly.

The present invention now will be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the relative sizes of regions may be exaggerated for clarity. It will be understood that when an element such as a layer, region or substrate is referred to as being "on" or "connected to" another element, it can be directly on or directly connected to the other element or intervening elements may also be present. In contrast, when an element is referred to as being "directly on" or "directly connected to" another element, there are no intervening elements present.

As used herein, "crimping" and variants thereof as used with reference to a conductor member and a terminal means that at least a portion of the conductor member (such as an inner metallic conductor or a surrounding insulation sleeve) is deformed or displaced to provide electrical and mechanical engagement between the conductor member and the terminal.

With reference to FIG. 1, a splice connector assembly 100 according to embodiments of the present invention is shown therein. The splice connector assembly 100 includes a connector body 105 having three body members: namely, a base 110 and a pair of caps 150, 170. The splice connector assembly 100 includes a plurality of splice sections or locations 102, each adapted to mechanically and electrically connect a respective pair 2 of conductor members 3, 5 as shown in FIG. 1. More particularly, the conductor pairs 2 are installed in the splice connector assembly 100 between the base 110 and the caps 150, 170. While four conductor pairs 2 are shown, the splice connector assembly 100 may be configured to receive and connect more or fewer conductor pairs. For example, the splice connector assembly 100 may be adapted to connect twenty-five pairs of conductor members. As discussed in greater detail below, the splice connector assembly 100 is adapted to mechanically and electrically connect the respective conductor members of each conductor pair 2 to one another.

Each conductor member 3, 5 may include an electrically conductive portion 3A, SA formed of metal (e.g., copper) or the like, and an electrically insulative sleeve 3B, 5B, for example, formed of a polymeric material. The splice connector assembly 100 may be used to splice low voltage wires from a telecommunications facility (i.e., a company or supply side) to wires leading to a customer facility (i.e., an output side) such as a home or business. There may be further splices or other devices between the splice connector assembly 100 and the telecommunications facility and/or the customer facility. The splice connector assembly 100 may be located in any suitable location, such as in an underground or above-ground terminal box or in a network interface device (NID).

Figure 2:
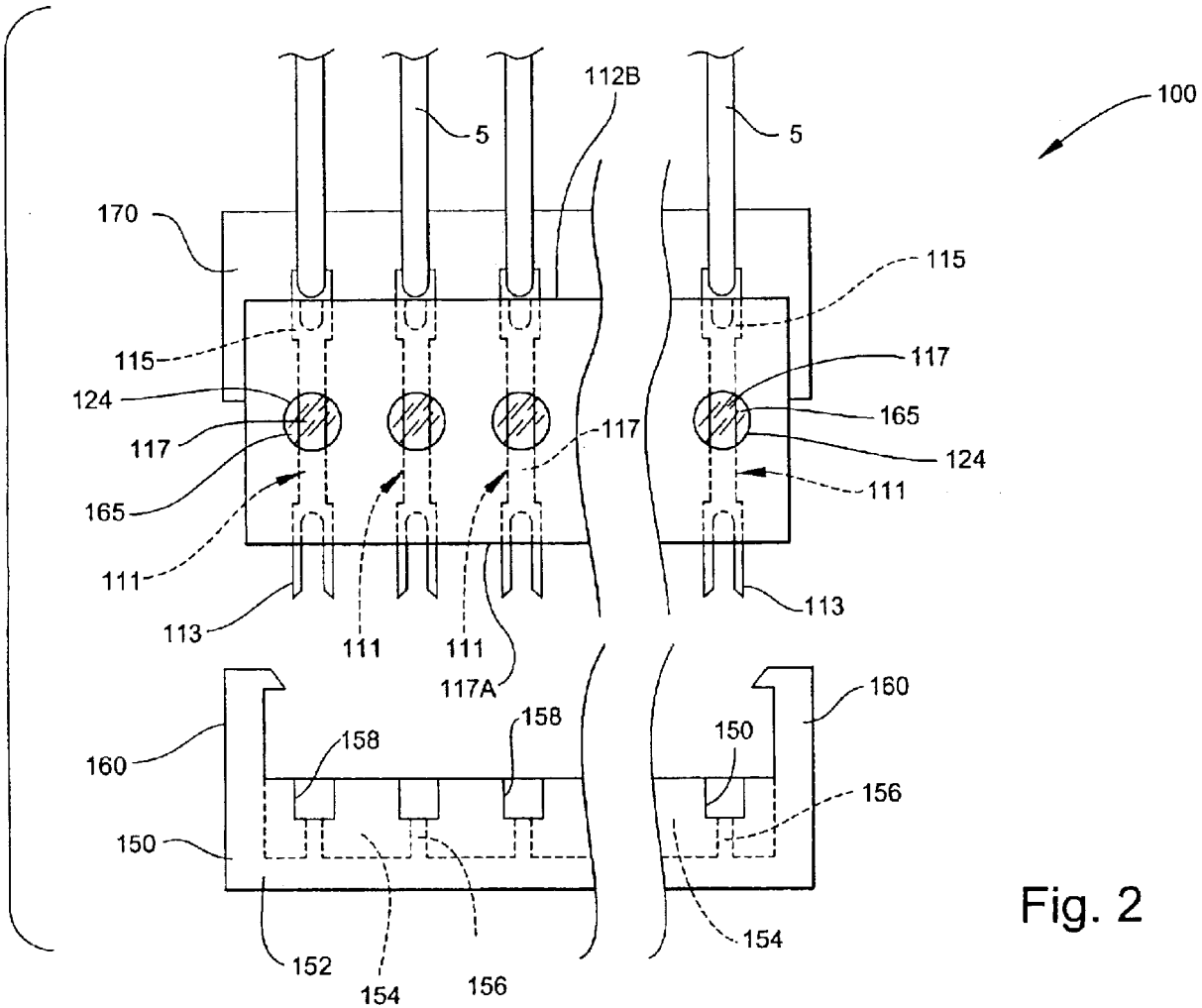
FIG. 2 is an exploded view of the splice connector assembly of FIG. 1 wherein only one conductor member of each conductor member pair is installed in the splice connector assembly.
Figure 3:
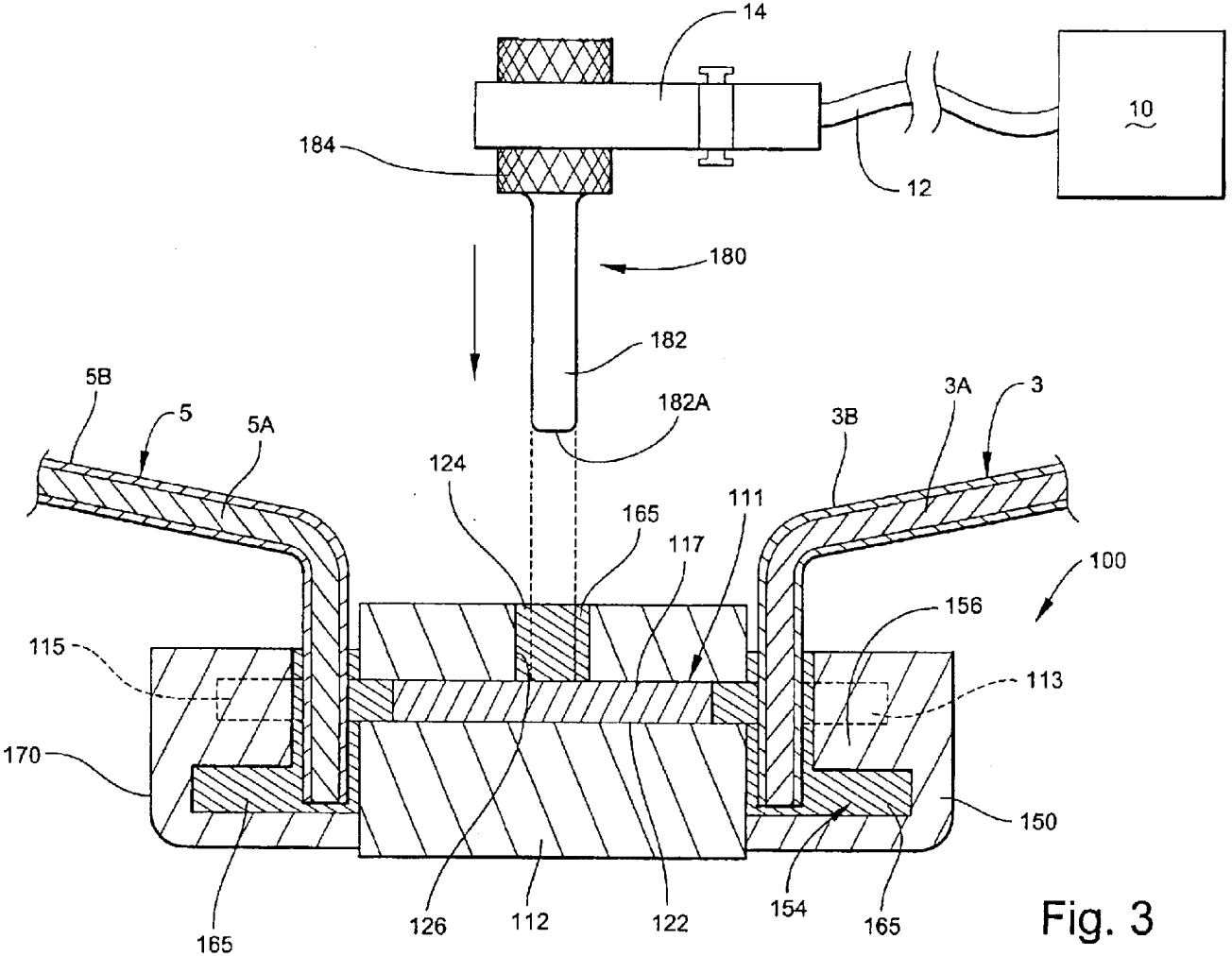
FIG. 3 is a cross-sectional view of the splice connector assembly of FIG. 1 taken along the line 3—3 of FIG. 1 along with a test probe pin and a testing device.
Figure 4:
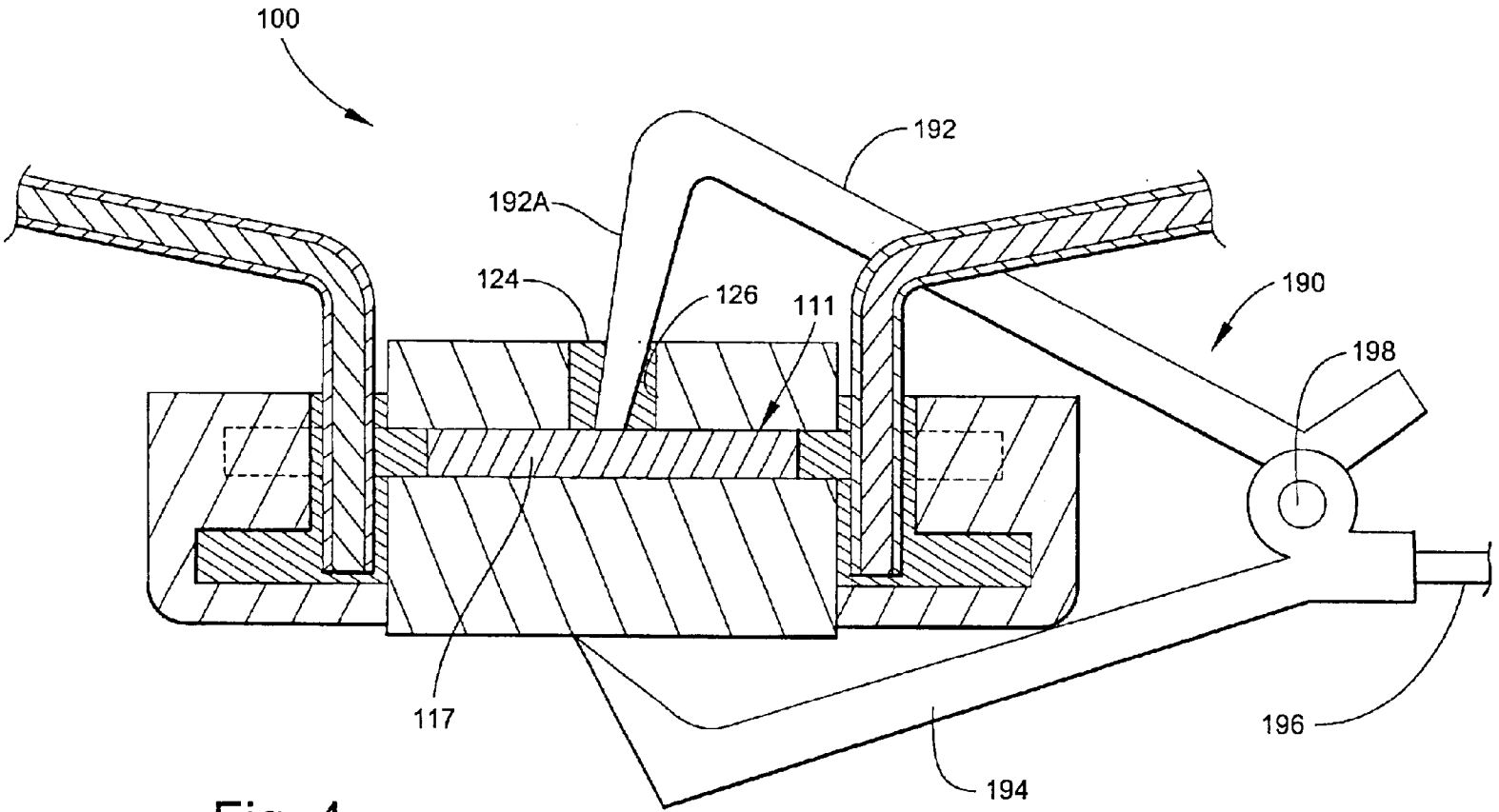
FIG. 4 is a cross-sectional view of the splice connector assembly of FIG. 1 taken along the line 3—3 of FIG. 1 and a test probe clamp.

The splice connector assembly 100 is further illustrated in FIGS. 2–4. In FIG. 2, the cap 150 is shown disassembled from the base 110 and only the conductor members 5 of each conductor pair 2 are installed.

The caps 150 and 170 may be substantially identical; accordingly, the following description of the cap 150 likewise applies to the cap 170. The cap 150 includes a body portion 152 defining a plurality of inwardly opening cavities 154. The cavities 154 are partitioned from one another by push walls 156, which terminate adjacent inwardly and upwardly opening slots or cutouts 158. A pair of latch arms 160 extend forwardly from the body portion 152 to permanently or removably secure the cap 150 to the base 110. Additional latches or other features may be provided to secure the caps 150, 170 to the base 110. For example, the caps 150, 170 can be connected to the base 110 by live hinges. The caps 150, 170 are preferably formed of a strong, resilient, electrically insulative material. According to some embodiments, the caps 150, 170 are formed of a molded polymeric material.

As best seen in FIG. 3, the base 110 includes a body 112. The body 112 has an axis A—A and first and second opposed sides 112A and 112B on either side of the axis A—A. The body 112 is preferably formed of a strong, resilient, electrically insulative material such as a molded polymeric material. A transverse terminal passage 122 is defined in the body 112 at each splice location 102 (FIG. 4). A transverse access passage 126 intersects each of the terminal passages 122. According to some embodiments, the access passages 126 are perpendicular to the respective terminal passages 122. Each of the access passages 126 also communicates with a respective opening 124 in a surface of the body 112.

The access passages 126 and openings 124 may be of any suitable shape. According to some embodiments, the diameter or maximum width of each passage 126 and each opening 124 is sized to be slightly layer (e.g., 0.001 to 0.008 inch larger) than the diameter of the associated probe. According to some embodiments, the diameter or maximum width is between about 0.0221 and 0.0273 inch. According to some embodiments, the depth of each passage 124 is at least about 0.002 inch.

A terminal member 111 is secured within each passage 122. Each terminal member 111 includes a central connecting portion 117 and a pair of terminals 113, 115 secured to and extending from opposed ends of the connecting portion 117. As discussed below, according to some embodiments, the terminals 113, 115 are adapted to couple the conductor members 3, 5 thereto by crimping. The terminal members 111 are preferably unitarily formed of a suitable electrically conductive metal such as copper, for example, by stamping.

According to some embodiments and as shown, each of the terminals 113, 115 is an insulation displacement terminal or an insulation displacement connector (IDC). Each of the IDCs includes a pair of cantilevered legs or tines defining a slot therebetween. The slot and the lines are sized and shaped to cut away or otherwise displace the insulation 3B or 5B of an appropriately sized conductor member such that the tines make secure contact with the metal conductor of the conductor member. The tines may thereby be somewhat separated so that they are biased against the conductive portion 3A or 5A of the conductor member. Suitable IDC configurations will be apparent to those of ordinary skill in the art upon reading the description herein. The IDCs 113, 115 extend outwardly from the body 112 to receive the respective conductor members 3, 5 as discussed below.

According to some embodiments, the splice connector assembly 100 may include a moisture resistant gel 165 in the access passages 126. Such gel may be injected into the splice connector assembly prior to or following assembly. According to some embodiments, the gel 165 also surrounds each of the terminals 113, 115 to reduce corrosive degradation of the electrical connection. According to some embodiments, the splice connector assembly 100 may be placed in a sealed, gel-filled bag or the like after assembly. Suitable gels are available from 3M Company of Minnesota.

The splice connector assembly 100 may be used in accordance with methods of the present invention as follows. Conductor members 3, 5 of the conductor pairs 2 to be spliced are secured to the splice connector assembly 100. More particularly, each of the conductor members 3, 5 is placed at or partially into its respective IDC 113, 115 from and along the associated side 112A or 112B of the body 112. The associated caps 150, 170 are then pushed onto the base 110 and over the IDCs 113, 115. The push walls 156 push the adjacent conductor members 3, 5 into the IDCs 113, 115 and may themselves be received in the IDCs 113, 115. As the conductor members 3, 5 enter the IDCs, the IDCs cut through the insulation sleeves 3B, 5B to make electrical contact with the metal conductor portions 3A, 5A. Notably, it is not necessary to strip the insulation 3B, 5B from the conductor portions 3A, 5A prior to inserting the conductor members 3 5 into the IDSs 113B, 115B. The caps 150, 170 may be forced onto the base 110 by hand or using a suitable crimping tool.

In this manner, the conductor members 3, 5 are crimped to the respective terminals 113, 115. The IDCs 113, 115 are received in the cavities 154 and the conductor members 3, 5 are received in the slots 158. The latch arms 160 retain the caps 150, 170 in position, thereby securely locking the conductor members 3, 5 to the splice connector assembly 100. The same method of assembly may be used for both sides of the splice connector assembly 100 (i.e., the cap 150 and the cap 170) sequentially or in tandem.

According to some embodiments, the foregoing assembly serves to substantially permanently secure the conductor members 3, 5 to the splice connector assembly 100. According to some embodiments, the conductor members 3, 5 once installed in the splice connector assembly 100 cannot be removed from the splice connector assembly without cutting the conductor members 3, 5 or destroying the conductor members 3, 5 or the splice connector assembly 100 in full or in part. The mechanical securement of the conductor members 3, 5 provided by the IDCs 113, 115 may be supplemented by the features and engagement between the base 110 and the caps 150, 170.

Once the conductor pairs 2 have been installed as described above, it may thereafter be desirable or necessary to test or diagnose an electrical characteristic of the conductor members 3, 5 of one or more of the pairs 2. This may be accomplished by inserting a probe, which is operably electrically connected with an electrical testing device, into and through the opening 124 and the passage 126 at the associated splice location 102 until the probe contacts the connecting portion 117 of the terminal member 111.

It will be appreciated that any electrical characteristic measurable by point contact may be measured in the foregoing manner, dependent on the capabilities of the testing device associated with the probe. The splice connector assembly 100 can be used to test wires of telecommunications lines, for example. The splice connector assembly 100 can be used to identify inoperable lines. The lines can be tested without taking the lines out of service.

According to some preferred embodiments, the diameter of the probe is between about 0.001 and 0.008 inch smaller than the diameter of the openings 124. According to some embodiments, the probe has a diameter in the range of the wire gauges for which the splice connector assembly 100 is intended. According to certain preferred embodiments, the probe has a diameter in the range of between about 0.0201 inch (corresponding to 24 AWG) and 0.0253 inch (corresponding to 22 AWG).

Conventionally, telecommunications lines are tested and diagnosed using an electrical telecom test set 10 or subscriber loop analyzer as schematically illustrated in FIG. 3. The test set 10 may measure, for example, current and/or voltage. Suitable test units include, for example, the Dynatel 965 subscriber loop analyzer available from 3M of Minnesota. Telecom test sets typically include an alligator clip 14 operatively electrically connected to the test set 10 by a cable 12. Often, it will be undesirable to form the opening 124 and passage 126 sufficiently large and/or shallow to enable contact with the connecting portion 117 by the alligator clip 14. In accordance with the present invention, an electrically conductive probe pin 180 may be provided. The probe pin 180 includes a holding tab 184 and an elongated probe portion 182. In use, the holding tab 184 is grasped by the alligator clip 14 to mechanically and electrically couple the test set 10 and the probe portion 182. Before or after the alligator clip is attached to the holding tab 184, the probe portion 182 is inserted into the passage 126 until the tip 182A of the probe pin 180 contacts the connecting portion 117 of the desired terminal member 111. According to some embodiments, the probe pin 180 is unitarily formed of a suitable metal. The holding tab 184 may be provided with a textured or knurled pattern or other features for facilitating the grip of the alligator clip 14 on the probe pin 180.

With reference to FIG. 4, an alternative probe device is shown therein. A probe clamp 190 in accordance with embodiments of the present invention is operably electrically coupled to an electrical test device such as the test set 10 by a cable 196. The probe clamp 190 includes opposed arms or jaws 192, 194 joined at a hinge. Preferably, the jaws 192, 194 are biased together by a spring or the like (not shown). At least the jaw 192 is electrically conductive (e.g., formed of metal). The probe clamp 190 can be temporarily attached to the splice connector assembly 100 as shown such that an extended, elongated probe leg 192A of the jaw 192 extends through the opening 124 and the passage 126 to contact the connecting portion 117 of the terminal member 111 associated with the wires of interest.

Figure 5:
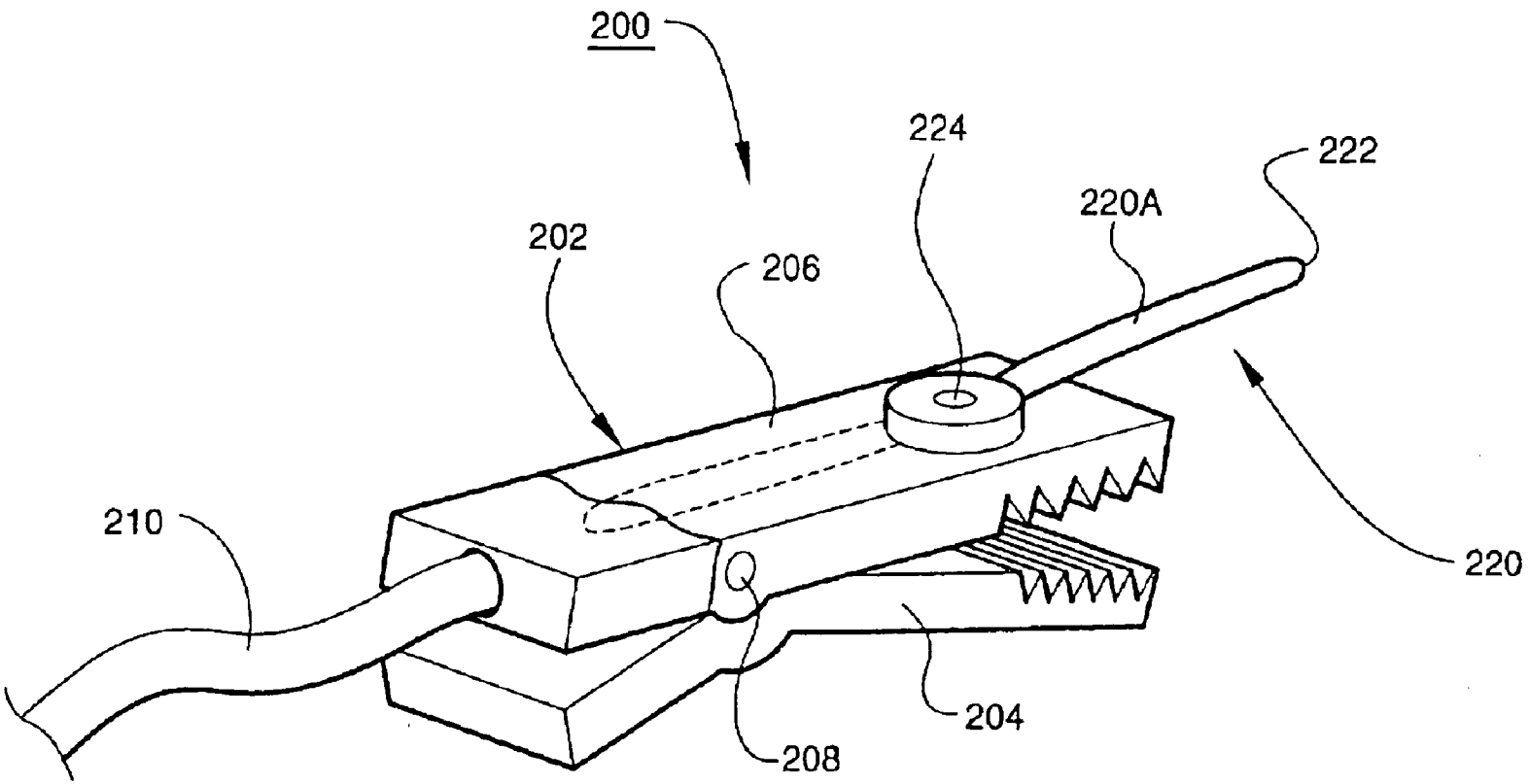
FIG. 5 is a perspective view of a test clamp assembly according to further embodiments of the present invention.

With reference to FIG. 5, a test clamp assembly 200 according to embodiments of the present invention is shown therein. The test clamp assembly 200 may be used with splice connector assemblies as described herein, or with any suitable connectors or other devices requiring an elongated probe.

The test clamp assembly 200 includes a clamp 202 which may be of conventional design. The clamp 202 includes opposed jaws or arms 204, 206 joined by a hinge 208. Preferably, the arms 204, 206 are biased together by a spring or the like (not shown). At least the arm 206 is electrically conductive (e.g., formed of metal). The arm 206 is operably electrically coupled to an electrical test device such as the test set 10 by a cable 210. It will be appreciated that the clamp 202 can be used in conventional manner to electrically couple the test set 10 to wires or the like.

The test clamp assembly 200 further includes a probe member 220 pivotally connected to the arm 206 by a rivet 224 or the like. The probe member 220 is also electrically coupled to the electrical test device. According to some embodiments, the probe member 220 is electrically connected to the cable 210 by the rivet 224 or other connector between the probe member 220 and the arm 206 and/or by the contacting surfaces of the probe member 220 and the arm 206.

The probe member 220 can be swiveled between a stored position as shown in dashed lines and an operational position as show in solid lines. According to some embodiments and as illustrated, the probe member 220 when in the stored position is substantially fully disposed within the periphery of the arm 206, and lies closely adjacent or within the arm 206. In the operational position, a portion 220A of the probe member 220 extends outwardly beyond the periphery of the arm 206.

The probe member 220 is sized and shaped to allow the probe portion 220A to be inserted through the passage 126 (or other associated passage) to provide contact between the connecting portion 117 (or other measurement contact surface) and the tip 222 of the probe member 220. As will be appreciated from the description herein, the test clamp assembly 200 thereby provides improved versatility and convenience in testing telecom lines and the like. Notably, the probe member 220 will not interfere with the operation of the clamp 202 when in the stored position.

Advantageously, each conductor pair 2 spliced using the splice connector assembly 100 described above can be tested independently of the other conductor pairs or groups of pairs. Optionally, the splice connector assembly 100 can be modified such that multiple conductor pairs are grouped together to allow multiple conductor pairs 2 to be tested at once.

While a multiple splice connector assembly 100 is shown and described, splice connector assemblies in accordance with the present invention may include only a single conductor pair splice location 102.

In accordance with some preferred embodiments and as illustrated above, the terminals of the splice connector assembly 100 may all be IDCs. However, it is not necessary that all such terminals be IDCs, or that all such terminals be adapted to crimp the received conductor members. Additionally, some of the conductor members may be installed by other means, such as by pre-molding during manufacture of the connector assembly.

According to some embodiments, splice connector assemblies according to the present invention (such as the splice connector assembly 100) are adapted to receive, connect and secure telecommunications wires sized in the range of from about 24 to 22 AWG.

Embodiments of splice connector assemblies according to the present invention as described above including multiple splice locations such that the two conductor members of each conductor pair are received on opposed sides of the splice connector assembly (e.g., sides 112A and 112B, respectively, of the splice connector assembly 100) may be particularly advantageous in some applications. A number of side-by-side supply wires may be efficiently and accurately paired and spliced with a number of output wires with reduced wire handling. In particular, such an arrangement may minimize or eliminate the need for individual wire placement.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. A splice connector assembly for mechanically and electrically connecting a plurality of conductor pairs, each of the conductor pairs including a first conductor member and a second conductor member, and for use with an electrical probe, the splice connector assembly comprising:

a) a connector body adapted to receive the first and second conductor members, the connector body including first and second body members, the first body member having first and second opposed sides, the second body member being adapted to engage the first body member;

b) a plurality of terminal members, each terminal member including:

a first terminal adapted to electrically engage a respective one of the first conductor members; and a second terminal electrically connected to the first terminal of the terminal member and being adapted to electrically engage a respective one of the second conductor members; and c) at least one access hole formed in the connector body and adapted to receive the probe such that the probe can selectively contact each of the terminal members;

d) wherein the splice connector assembly is arranged and configured to crimp each of the first conductor members to a respective one of the first terminals when the first and second body members are engaged with the first conductor members positioned therebetween; and e) wherein the connector body is adapted to receive the first conductor members from the first side thereof to engage the first terminals, and is adapted to receive the second conductor members from the second side thereof to engage the second terminals;

f) wherein the splice connector assembly is arranged and configured to crimp each of the second conductor members to a respective one of the second terminals; and g) wherein:

the connector body includes a third body member adapted to engage the first body member; and the splice connector assembly is arranged and configured to crimp each of the second conductor members to a respective one of the second terminals when the first and third body members are engaged with the second conductor members positioned therebetween.

2. The splice connector assembly of claim 1 wherein the first and second terminals extend outwardly from the first and second sides of the first body member, respectively.

3. The splice connector assembly of claim 1 wherein each of the second terminals includes a second insulation displacement connector.

4. The splice connector assembly of claim 1 wherein each of the terminal members is integrally formed and includes a central connector portion extending between the first and second terminals thereof.

5. The splice connector assembly of claim 1 wherein the connector body defines at least one cavity to receive each of the first conductor members and each of the first terminals.

6. The splice connector assembly of claim 1 wherein the first and second body members are each formed of a polymeric material.

7. The splice connector assembly of claim 1 including a moisture-resistant gel disposed in the at least one access hole.

8. The splice connector assembly of claim 1 wherein the at least one access hole includes a plurality of access holes.

9. The splice connector assembly of claim 8 including an access bole for each terminal member.

10. The splice connector assembly of claim 9 wherein each access hole has a maximum width of between about 0.0221 and 0.0273 inch.

11. The splice connector assembly of claim 1 wherein each of the first terminals includes an insulation displacement connector.

12. The splice connector assembly of claim 11 wherein the first body member, the second body member, and the first terminals arm relatively arranged and configured to push each of the first conductor members into a respective one of the insulation displacement connectors when the first body member and the second body member are forced into engagement with the first conductor members positioned therebetween.

13. A splice connector assembly for mechanically and electrically connecting a conductor pair including a first conductor member and a second conductor member, and for use with an electrical probe, the splice connector assembly comprising:

a) a connector body adapted to receive the first and second conductor members, the connector body including first and second body members, the first body member having first and second opposed sides, the second body member being adapted to engage the first body member;

b) a terminal member including:

a first terminal disposed on the first side of the first body member and adapted to electrically engage the first conductor member; and a second terminal disposed on the second side of the first body member and electrically connected to the first terminal, the second terminal being adapted to electrically engage the second conductor member; and c) an access hole formed in the connector body and adapted to receive the probe such that the probe can selectively contact the terminal member;

d) wherein the splice connector assembly is arranged and configured to crimp the first conductor member to the first terminal when the first and second body members are engaged with the first conductor member positioned therebetween;

e) wherein the connector body is adapted to receive the first conductor member from the first side thereof to engage the first terminal, and is adapted to receive the second conductor member from the second side thereof to engage the second terminal;

f) wherein the splice connector assembly is arranged and configured to crimp the second conductor member to the second terminal; and g) wherein:

the connector body includes a third body member adapted to engage the first body member; and the splice connector assembly is arranged and configured to crimp the second conductor member to the second terminal when the first and third body members are engaged with the second conductor member positioned therebetween.

14. The splice connector assembly of claim 13 wherein the first and second terminals extend outwardly from the first and second sides of the first body member, respectively.

15. The splice connector assembly of claim 13 wherein the second terminal includes a second insulation displacement connector.

16. The splice connector assembly of claim 13 wherein the terminal member is integrally formed and includes a central connector portion extending between the first and second terminals.

17. The splice connector assembly of claim 13 wherein the connector body defines a cavity to receive the first conductor member and the first terminal.

18. The splice connector assembly of claim 13 wherein the first and second body members are each formed of a polymeric material.

19. The splice connector assembly of claim 13 including a moisture-resistant gel disposed in the access hole.

20. The splice connector assembly of claim 13 wherein the access hole has a maximum width of between about 0.0221 and 0.0273 inch.

21. The splice connector assembly of claim 20 wherein the first terminal includes an insulation displacement connector.

22. The splice connector assembly of claim 21 wherein the first body member, the second body member, and the first terminal are relatively arranged and configured to push the first conductor member into the insulation displacement connector when the first body member and the second body member are forced into engagement with the first conductor member positioned therebetween.

23. A splice connector assembly for mechanically and electrically connecting a plurality of conductor pairs, each of the conductor pairs including a first conductor member and a second conductor member, and for use with an electrical probe, the splice connector assembly comprising:

a) a connector body adapted to receive the first and second conductor members, the connector body including first and second body members, the first body member having first and second opposed sides, the second body member being adapted to engage the first body member;

b) a plurality of terminal members, each terminal member including:

a first terminal adapted to electrically engage a respective one of the first conductor members; and a second terminal electrically connected to the first terminal of the terminal member and being adapted to electrically engage a respective one of the second conductor members;

c) at least one access hole formed in the connector body and adapted to receive the probe such that the probe can selectively contact each of the terminal members; and d) a moisture-resistant gel disposed in the at least one access hole;

e) wherein the splice connector assembly is arranged and configured to crimp each of the first conductor members to a respective one of the first terminals when the first and second body members are engaged with the first conductor members positioned therebetween; and f) wherein the connector body is adapted to receive the first conductor members from the first side thereof to engage the first terminals, and is adapted to receive the second conductor members from the second side thereof to engage the second terminals.

24. A splice connector assembly for mechanically and electrically connecting a conductor pair including a first conductor member and a second conductor member, and for use with an electrical probe, the splice connector assembly comprising:

a) a connector body adapted to receive the first and second conductor members, the connector body including first and second body members, the first body member having first and second opposed sides, the second body member being adapted to engage the first body member;

b) a terminal member including:

a first terminal disposed on the first side of the first body member and adapted to electrically engage the first conductor member; and a second terminal disposed on the second side of the first body member and electrically connected to the first terminal, the second terminal being adapted to electrically engage the second conductor member;

c) an access hole formed in the connector body and adapted to receive the probe such that the probe can selectively contact the terminal member; and d) a moisture-resistant gel disposed in the access hole;

e) wherein the splice connector assembly is arranged and configured to crimp the first conductor member to the first terminal when the first and second body members are engaged with the first conductor member positioned therebetween;

f) wherein the connector body is adapted to receive the first conductor member from the first side thereof to engage the first terminal, and is adapted to receive the second conductor member from the second side thereof to engage the second terminal.

25. A splice connector assembly for mechanically and electrically connecting a plurality of conductor pairs, each of the conductor pairs including a first conductor member and a second conductor member, and for use with an electrical probe, the splice connector assembly comprising:

a) a connector body adapted to receive the first and second conductor members, the connector body including first and second body members, the first body member having first and second opposed sides, the second body member being adapted to engage the first body member;

b) a plurality of terminal members, each terminal member including:

a first terminal adapted to electrically engage a respective one of the first conductor members; and a second terminal electrically connected to the first terminal of the terminal member and being adapted to electrically engage a respective one of the second conductor members; and c) at least one access hole formed in the connector body and adapted to receive the probe such that the probe can selectively contact each of the terminal members;

d) wherein the splice connector assembly is arranged and configured to crimp each of the first conductor members to a respective one of the first terminals when the first and second body members are engaged with the first conductor members positioned therebetween; and e) wherein the connector body is adapted to receive the first conductor members from the first side thereof to engage the first terminals, and is adapted to receive the second conductor members from the second side thereof to engage the second terminals; and f) wherein the first and second terminals extend outwardly from the first and second sides of the first body member, respectively.

26. A splice connector assembly for mechanically and electrically connecting a conductor pair including a first conductor member and a second conductor member, and for use with an electrical probe, the splice connector assembly comprising:

a) a connector body adapted to receive the first and second conductor members, the connector body including first and second body members, the first body member having first and second opposed sides, the second body member being adapted to engage the first body member;

b) a terminal member including:

a first terminal disposed on the first side of the first body member and adapted to electrically engage the first conductor member; and a second terminal disposed on the second side of the first body member and electrically connected to the first terminal, the second terminal being adapted to electrically engage the second conductor member; and c) an access hole formed in the connector body and adapted to receive the probe such that the probe can selectively contact the terminal member;

d) wherein the splice connector assembly is arranged and configured to crimp the first conductor member to the first terminal when the first and second body members are engaged with the first conductor member positioned therebetween;

e) wherein the connector body is adapted to receive the first conductor member from the first side thereof to engage the first terminal, and is adapted to receive the second conductor member from the second side thereof to engage the second terminal; and f) wherein the first and second terminals extend outwardly from the first and second sides of the first body member, respectively.

27. A splice connector assembly for mechanically and electrically connecting a plurality of conductor pairs, each-of the conductor pairs including a first conductor member and a second conductor member, and for use with an electrical probe, the splice connector assembly comprising:

a) a connector body adapted to receive the first and second conductor members, the connector body including first and second body members, the first body member having first and second opposed sides, the second body member being adapted to engage the first body member;

b) a plurality of terminal members, each terminal member being integrally formed and including:

a first terminal adapted to electrically engage a respective one of the first conductor members;

a second terminal electrically connected to the first terminal of the terminal member and being adapted to electrically engage a respective one of the second conductor members; and a central connector portion extending between the first and second terminals thereof;

c) at least one access hole formed in the connector body and adapted to receive the probe such that the probe can selectively contact the central connecting portion of each of the terminal members, wherein the at least one access hole is located between the first and second sides and adjacent the central connecting portion of each of the terminal members;

d) wherein the splice connector assembly is arranged and configured to crimp each of the first conductor members to a respective one of the first terminals when the first and second body members are engaged with the first conductor members positioned therebetween; and e) wherein the connector body is adapted to receive the first conductor members from the first side thereof to engage the first terminals, and is adapted to receive the second conductor members from the second side thereof to engage the second terminals.

28. A splice connector assembly for mechanically and electrically connecting a conductor pair including a first conductor member and a second conductor member, and for use with an electrical probe, the splice connector assembly comprising:

a) a connector body adapted to receive the first and second conductor members, the connector body including first and second body members, the first body member having first and second opposed sides, the second body member being adapted to engage the first body member;

b) an integrally formed terminal member including:

a first terminal disposed on the first side of the first body member and adapted to electrically engage the first conductor member;

a second terminal disposed on the second side of the first body member and electrically connected to the first terminal, the second terminal being adapted to electrically engage the second conductor member; and a central connector portion extending between the first and second terminals thereof;

c) an access hole formed in the connector body and adapted to receive the probe such that the probe can selectively contact the central connecting portion of the terminal member, wherein the access hole is located between the first and second sides and adjacent the central connecting portion of the terminal member;

d) wherein the splice connector assembly is arranged and configured to crimp the first conductor member to the first terminal when the first and second body members are engaged with the first conductor member positioned therebetween; and e) wherein the connector body is adapted to receive the first conductor member from the first side thereof to engage the first terminal, and is adapted to receive the second conductor member from the second side thereof to engage the second terminal.

* * * * *